US010487376B2

(12) United States Patent
Goehler et al.

(10) Patent No.: US 10,487,376 B2
(45) Date of Patent: Nov. 26, 2019

(54) NICKEL-BASED ALLOY WITH OPTIMIZED MATRIX PROPERTIES

(71) Applicant: MTU Aero Engines AG, Munich (DE)

(72) Inventors: Thomas Goehler, Dachau (DE); Ernst Affeldt, Groebenzell (DE); Ralf Rettig, Erlangen (DE); Robert F. Singer, Erlangen (DE); Steffen Neumeier, Erlangen (DE); Mathias Goeken, Moehrendorf (DE); Ernst Fleischmann, Bayreuth (DE); Uwe Glatzel, Bayreuth (DE); Rainer Voelkl, Bayreuth (DE)

(73) Assignee: MTU AERO ENGINES AG, Munich (DE)

( * ) Notice: Subject to any disclaimer, the term of this patent is extended or adjusted under 35 U.S.C. 154(b) by 1064 days.

(21) Appl. No.: 14/677,743

(22) Filed: Apr. 2, 2015

(65) Prior Publication Data

US 2015/0284824 A1 Oct. 8, 2015

(30) Foreign Application Priority Data

Apr. 4, 2014 (EP) ..... 14163477

(51) Int. Cl.

| | |
|---|---|
| ***C22C 1/00*** | (2006.01) |
| ***C22C 19/00*** | (2006.01) |
| ***C22C 19/05*** | (2006.01) |
| ***F01D 5/28*** | (2006.01) |

(52) U.S. Cl.

CPC ..... *C22C 19/057* (2013.01); *C22C 1/00* (2013.01); *C22C 19/056* (2013.01); *F01D 5/28* (2013.01)

(58) Field of Classification Search

CPC ..... C22C 19/057; C22C 19/05; C22C 19/056; C22C 19/058

USPC ..... 420/448, 445, 442, 446, 447

See application file for complete search history.

(56) References Cited

U.S. PATENT DOCUMENTS

| | | | | |
|---|---|---|---|---|
| 6,054,096 | A * | 4/2000 | Duhl | C22C 19/057 420/442 |
| 2010/0196191 | A1* | 8/2010 | Strangman | C22C 19/05 420/448 |
| 2014/0119941 | A1 | 4/2014 | Rettig et al. | |
| 2014/0356183 | A1 | 12/2014 | Singer et al. | |

FOREIGN PATENT DOCUMENTS

| | | | |
|---|---|---|---|
| CA | 2414019 | A1 | 6/2003 |
| EP | 1319729 | A1 | 6/2003 |
| EP | 2725110 | A1 | 4/2014 |
| JP | 2012128912 | A * | 7/2012 |
| WO | 2013083101 | A1 | 6/2013 |

OTHER PUBLICATIONS

JP-2012128912-A computer english translation (Year: 2012).*

* cited by examiner

*Primary Examiner* — Erin B Saad

(74) *Attorney, Agent, or Firm* — Abel Schillinger, LLP

(57) ABSTRACT

The invention relates to a nickel-based alloy having a microstructure with a matrix of γ-phase and precipitates of γ'-phase. The γ'-phase comprises a percentage by volume of from 50 vol % to 80 vol % in the temperature range of from 1000° C. to 1100° C. The nickel-based alloy comprises 8 to 13 at % aluminum, 3 to 14 at % cobalt, 4 to 12 at % chromium, 0.6 to 8 at % molybdenum, 0 to 6 at % rhenium, 0.5 to 4 at % tantalum, 0.5 to 4 at % titanium, 0.3 to 3.5 at % tungsten, 0 to 4 at % germanium, 0 to 0.6 at % hafnium, 0 to 4 at % ruthenium, balance nickel and unavoidable impurities. The concentrations of molybdenum and tungsten are selected such that the percentage X of molybdenum and tungsten in the γ-phase, $X=0.84\ C_{Mo}+C_{W}$, is greater than 5.5 at % at a temperature of from 1000° C. to 1100° C., $C_{Mo}$ and $C_{W}$ being the concentrations of molybdenum and tungsten in at %.

20 Claims, No Drawings

NICKEL-BASED ALLOY WITH OPTIMIZED MATRIX PROPERTIES

CROSS-REFERENCE TO RELATED APPLICATIONS

The present application claims priority under 35 U.S.C. § 119 of European Patent Application No. 14163477.4, filed Apr. 4, 2014, the entire disclosure of which is expressly incorporated by reference herein.

BACKGROUND OF THE INVENTION

1. Field of the Invention

The present invention relates to a nickel-based alloy and to objects manufactured from said nickel-based alloy, such as the blades of continuous flow machines, and a method for producing a corresponding nickel-based alloy.

2. Discussion of Background Information

Nickel-based alloys, and particularly nickel-based superalloys, are often used as the material from which blades are made, for example, in continuous flow machines such as stationary gas turbines or aircraft engines, because these materials have sufficient mechanical strength even at high temperatures to withstand the high mechanical loads to which they are exposed. In particular, when they are used in continuous flow machines under the prevailing ambient conditions with high operating temperatures and high mechanical loads due to centrifugal forces, such materials must also exhibit good creep resistance.

Nickel-based alloys are understood to be alloys in which the main component of the alloy, that is to say the component of the alloy present in the highest percentage, is nickel. Nickel-based superalloys in turn refer to alloys with a high percentage of components that have been added to the alloy, and which include intermetallic precipitates to confer particular hardness on the material. Accordingly, nickel-based superalloys such as IN718, CMSX-4, PWA1497 or René N6 have special microstructures that are essential prerequisites for the advantageous high-temperature properties of the materials.

Accordingly, nickel-based superalloys of such kind include cubic precipitates of a γ'-phase in a γ-matrix, so that precipitate hardening is brought about by the γ'-phase. Moreover, the alloy components in the γ-matrix also harden the mixed crystals.

Although this means that materials well suited to high-temperature applications in gas turbines or aircraft engines already exist, there is still a need to optimize corresponding alloys, to raise their operating temperatures and/or load limits still further, and generally to improve the characteristics profile thereof. Given dwindling resources, a further objective is to make optimal use of the alloy components, or to be able to replace them with other components.

It would therefore be advantageous to have available a nickel-based alloy and a method for producing said alloy, in which the alloy components included are used efficiently to achieve a balanced characteristics profile and in particular good strength and good creep resistance at high operating temperatures, wherein the alloy allows the composition to be varied within wide limits.

SUMMARY OF THE INVENTION

The present invention provides a nickel-based alloy, an article made from such a nickel-based alloy, and methods for producing a nickel-based alloy as set forth in the independent claims. The dependent claims relate to advantageous embodiments.

In order to optimize the characteristics profile of a nickel-based alloy and enable efficient use and variable inclusion of alloy components, the invention proposes a nickel-based alloy having a chemical composition comprising 8 to 13 at % aluminum, 3 to 14 at % cobalt, 4 to 12 at % chromium, 0.6 to 8 at % molybdenum, 0 to 6 at % rhenium, 0.5 to 4 at % tantalum, 0.5 to 4 at % titanium, 0.3 to 3.5 at % tungsten, 0 to 4 at % germanium, 0 to 0.6 at % hafnium, 0 to 4 at % ruthenium, balance nickel and unavoidable impurities.

In a nickel-based alloy having such a composition, the chemical composition thereof is further selected such that a microstructure with a matrix of γ-phase and precipitates of γ'-phase can be formed, wherein the γ'-phase fraction, in the temperature range of from 1000° C. to 1100° C. constitutes from 50 vol % to 80 vol %, preferably from 60 vol % to 80 vol % and in particular from 70 vol % to 80 vol % thereof. The γ'-volume percentage may in particular be adjusted by suitable selection of the germanium, aluminum, titanium and tantalum percentages. In this case, it is advantageous if the aluminum percentage is minimized, while the percentage of germanium, titanium and/or tantalum is maximized, either for each element thereof individually, or taken together for a plurality of or all of said elements, wherein the limit condition to the effect that the γ'-phase is present in the microstructure of the nickel-based alloy in a percentage of from 50 vol % to 80 vol % is to be maintained.

Correspondingly, the aluminum percentage may in particular be selected in a range of the minimum for the aluminium percentage plus 30%, more particularly plus 20%, preferably plus 10%, up to the minimum for the aluminum percentage, at fixed or maximum percentages for germanium, titanium and tantalum in order to preserve the γ'-phase percentage within the limits of the chemical composition described hereinabove. Correspondingly, the percentages of germanium, tantalum and/or titanium may each be selected, individually or for a plurality or all of these elements, in ranges that correspond to the respective percentage maxima minus 30%, more particularly minus 20%, preferably minus 10% up to the maximum. The limit condition for a γ'-phase percentage of from 50 vol % to 80 vol % is to be maintained both when determining the aluminum content and when determining the percentages of germanium, tantalum and/or titanium, in such manner that the corresponding minima and maxima for each of the percentages may be determined for a minimum or maximum γ'-phase percentage or an average or intermediate value therefor, that is to say for example for 50 vol %, 65 vol % and 80 vol % γ'-phase in the microstructure within a temperature range of from 1000° C. to 1100° C.

In particular, the aluminum content may be selected in the range of from 9 to 12 at %, preferably from 10 to 12 at %.

Besides the chemical composition of the nickel-based alloy according to the invention and the adjustment of the nickel-based alloy with a γ'-phase percentage of from 50 vol % to 80 vol %, preferably 60 vol % to 80 vol %, and more particularly 70 vol % to 80 vol % described hereinabove, it is proposed according to the invention that the percentages of molybdenum and/or tungsten are selected in a certain manner in order to both optimize mixed crystal hardening of the γ-phase in the matrix by incorporating corresponding alloy components in the γ-phase, and to improve the resistance of the γ'-precipitates. Since the mechanical properties of the nickel-based superalloys are strongly influenced by the γ'-precipitates, it has been found to be particularly important to select the alloy components in such manner that the γ'-precipitates are preserved in their originally adjusted shape and size to the extent possible. To this end, it is advantageous to prevent the γ'-precipitates from being coarsened and to prevent or at least render the diffusion essential therefor more difficult by appropriate selection of the alloy composition. For the mixed crystal hardening of the γ-phase, the composition of the alloy is of importance to the extent that the incorporation of extraneous atoms in the γ-phase may also be optimized by the alloy composition.

Accordingly, it is proposed according to the invention to select the chemical composition of the nickel-based alloy such that in terms of the elements molybdenum and tungsten the weighted percentage X, corresponding to the relationship $X=0.84C_{Mo}+C_W$ is greater than 5.5 at % at a temperature in the range of from 1000° C. to 1100° C., wherein $C_{Mo}$ is the concentration of molybdenum and $C_W$ is the concentration of tungsten in the γ-phase of the matrix, each expressed in at %. When such a selection of the molybdenum and tungsten components is made, optimal mixed-crystal hardening the γ-phase is achieved.

Alternatively or in combination therewith, the concentration of the alloy component tungsten may be selected such that a material parameter φ, which describes the diffusion inflow when the γ-precipitates are coarsened, is less than or equal to 0.05, wherein φ is defined by the following equation:

$$\varphi = \frac{1}{D_{Ni}}\left[\frac{c'_W - c_W}{c_W D_W}\right]^{-1}$$

wherein $c_w$ is the concentration of tungsten in the matrix in at %, $c'_w$ is the concentration of tungsten in the γ'-phase in at %, $D_w$ is the coefficient of diffusion of the tungsten and $D_{Ni}$ is the coefficient of diffusion of nickel taking into account the solubility differential of the elements between the matrix and the γ'-phase.

The nickel-based alloy may still be selected such that the distribution ratio of tungsten and/or molybdenum of the γ-matrix relative to the γ'-precipitates is set so that the concentration of tungsten and/or molybdenum in the matrix relative to the respective concentration of tungsten and/or molybdenum in the γ'-phase is greater than 1, particularly equal to or greater than 1.5. This distribution ratio of the concentration of tungsten and/or molybdenum from the γ-phase to the γ'-phase may also be influenced by adjusting the chemical composition of the alloy in terms of the components tantalum, titanium and/or germanium.

Additionally, the nickel-based alloy may be optimized such that the alloy has a solidus temperature higher than 1300° C., and/or that the γ-/γ'-mismatch is in the range of from −0.15% to −0.25% in the temperature range of from 1000° C. to 1100° C., wherein the γ-/γ'-mismatch is the difference between the lattice constants of the two phases γ and γ', standardized on the averaged value of the lattice constants.

In addition, impurities or trace elements such as bismuth, selenium, thallium, lead, tellurium or sulfur may also be minimized to technically achievable purity ranges.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show details of the present invention in more detail than is necessary for the fundamental understanding of the present invention, the description making apparent to those of skill in the art how the several forms of the present invention may be embodied in practice.

An alloy including about 10 at % Al, 14 at % Co, 7 at % Cr, 2 at % Mo, 2.5 at % Ta, 3 at % Ti and 2.5 at % W, balance nickel, which has been prepared according to the present invention, has optimized properties in terms of percentage by volume of the γ'-phase, liquidus temperature, mixed crystal hardening, coarsening of the γ'-precipitates and the γ-/γ'-mismatch. For example, the γ-/γ'-mismatch has a value of −0.25% and the solidus temperature is 1301° C. The percentage of the γ'-phase is 46 mol % and with values of about 3.5 at % in each case the concentrations of W and Mo in the γ-phase are high enough for them to contribute significantly to mixed crystal hardening. In addition, the percentages of W and Mo in combination with the selected concentrations of the other alloy components are effective in preventing coarsening of the γ'-phase at high operating temperatures. Particularly through the combination of the properties obtained taking into account the alloy components used, the alloy is extremely well suited for applications at high temperatures, such as in continuous flow machines, and particularly in aircraft turbines.

While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

To sum up, the present invention provides:

1. A nickel-based alloy having a microstructure with a matrix of γ-phase and precipitates of γ'-phase, wherein the γ'-phase comprises a percentage by volume of from 50 vol % to 80 vol % in the temperature range of from 1000° C. to 1100° C., and wherein the nickel-based alloy has a chemical composition according to which the nickel-based alloy comprises
   8 to 13 at % aluminum,
   3 to 14 at % cobalt,
   4 to 12 at % chromium,
   0.6 to 8 at % molybdenum,
   0 to 6 at % rhenium,
   0.5 to 4 at % tantalum,
   0.5 to 4 at % titanium,
   0.3 to 3.5 at % tungsten,
   0 to 4 at % germanium,
   0 to 0.6 at % hafnium,
   0 to 4 at % ruthenium,
   balance nickel and unavoidable impurities, wherein the chemical composition in terms of the elements molybdenum and tungsten is selected such that the percentage X of molybdenum and tungsten in the γ-phase, weighted according to the relationship $X=0.84C_{Mo}+$ $C_W$, is greater than 5.5 at % at temperatures in the range of from 1000° C. to 1100° C., $C_{Mo}$ and $C_W$ being the concentrations of molybdenum and tungsten expressed in at %.

2. A nickel-based alloy having a microstructure with a matrix of γ-phase and precipitates of γ'-phase, wherein the γ'-phase comprises a percentage by volume of from 50 vol % to 80 vol % in the temperature range of from 1000° C. to 1100° C., and wherein the nickel-based alloy has a chemical composition according to which the nickel-based alloy comprises
   8 to 13 at % aluminum,
   3 to 14 at % cobalt,
   4 to 12 at % chromium,
   0.6 to 8 at % molybdenum,
   0 to 6 at % rhenium,
   0.5 to 4 at % tantalum,
   0.5 to 4 at % titanium,
   0.3 to 3.5 at % tungsten,
   0 to 4 at % germanium,
   0 to 0.6 at % hafnium,
   0 to 4 at % ruthenium,
   balance nickel and unavoidable impurities, wherein the chemical composition in terms of the element tungsten is selected such that the material parameter φ, is less than or equal to 0.05, wherein φ is defined by:

$$\varphi = \frac{1}{D_{Ni}}\left[\frac{c'_W - c_W}{c_W D_W}\right]^{-1}$$

wherein $c_w$ is the concentration of tungsten in the matrix in at %, $c'_w$ is the concentration of tungsten in the γ'-phase in at % and $D_w$ is the coefficient of diffusion of tungsten and $D_{Ni}$ is the coefficient of diffusion of nickel taking into account the solubility differential of the elements between the matrix and the γ'-phase.

3. The nickel-based alloy according to item 2, wherein the chemical composition in terms of the elements molybdenum and tungsten is selected such that the percentage X of molybdenum and tungsten in the γ-phase, weighted according to the relationship $X=0.84C_{Mo}+C_W$, is greater than 5.5 at % at temperatures in the range of from 1000° C. to 1100° C., $C_{Mo}$ and $C_W$ being the concentrations of molybdenum and tungsten expressed in at %.

4. The nickel-based alloy according to any one of the preceding items, wherein the aluminum percentage is minimized depending on the percentages of germanium, titanium and tantalum, the aluminum percentage being selected particularly in the range of the minimum plus 30%, more particularly plus 20%, preferably plus 10%, when a minimum, average or maximum percentage of the γ'-phase is set.

5. The nickel-based alloy according to item 4, wherein the percentage of germanium, tantalum or titanium is maximized, either for each element individually or taken together, the respective percentage being selected particularly in the range of the maximum minus 30%, more particularly minus 20%, preferably minus 10% when a minimum, average or maximum percentage of the γ'-phase is set.

6. The nickel-based alloy according to any one of the preceding items, wherein the aluminum content is from 9 to 12 at %, particularly from 10 to 12 at %.

7. The nickel-based alloy according to any one of the preceding items, wherein the distribution ratio of the concentration of tungsten and/or molybdenum in the matrix relative to the respective concentration of tungsten and/or molybdenum in the γ'-phase is greater than 1, particularly equal to or greater than 1.5.

8. An article of a nickel-based alloy according to any one of the preceding items.

9. The article according to item 8, wherein the nickel-based alloy is monocrystalline or directionally solidified.

10. The article according to one or both of items 8 and 9, wherein the article is a component, particularly a blade of a continuous flow machine, particularly of a gas turbine or an aircraft engine.

11. A method for producing a nickel-based alloy, particularly according to any one of items 1 to 7, in which in order to determine the chemical composition, in a first step a chemical composition is selected according to which the nickel-based alloy comprises
   8 to 13 at % aluminum,
   3 to 14 at % cobalt,
   4 to 12 at % chromium,
   0.6 to 8 at % molybdenum,
   0 to 6 at % rhenium,
   0.5 to 4 at % tantalum,
   0.5 to 4 at % titanium,
   0.3 to 3.5 at % tungsten,
   0 to 4 at % germanium,
   0 to 0.6 at % hafnium,
   0 to 4 at % ruthenium,
   balance nickel and unavoidable impurities, wherein in a second step the chemical composition is selected such that a microstructure with a matrix of γ-phase and precipitates of γ'-phase is formed in the nickel-based alloy,
   wherein in a third step the chemical composition is selected such that the γ'-phase has a percentage by volume of from 50 vol % to 80 vol % in the temperature range of from 1000° C. to 1100° C.,
   and wherein in a fourth step the chemical composition is selected in terms of the elements molybdenum and tungsten such that the percentage X of molybdenum and tungsten in the γ-phase, weighted according to the relationship $X=0.84C_{Mo}+C_W$, is greater than 5.5 at % at temperatures in the range of from 1000° C. to 1100° C., $C_{Mo}$ and $C_W$ being the concentrations of molybdenum and tungsten expressed in at %.

12. A method for producing a nickel-based alloy, particularly according to any one of items 1 to 7, in which in order to determine the chemical composition, in a first step a chemical composition is selected according to which the nickel-based alloy comprises
   8 to 13 at % aluminum,
   3 to 14 at % cobalt,
   4 to 12 at % chromium,
   0.6 to 8 at % molybdenum,
   0 to 6 at % rhenium,
   0.5 to 4 at % tantalum,
   0.5 to 4 at % titanium,
   0.3 to 3.5 at % tungsten,
   0 to 4 at % germanium,
   0 to 0.6 at % hafnium,
   0 to 4 at % ruthenium,
   balance nickel and unavoidable impurities, wherein in a second step the chemical composition is selected such that a microstructure with a matrix of γ-phase and precipitates of γ'-phase is formed in the nickel-based alloy, wherein in a third step the chemical composition is selected such that the γ'-phase has a percentage by volume of from 50 vol % to 80 vol % in the temperature range of from 1000° C. to 1100° C., wherein in a fourth step the chemical composition is selected in terms of the element tungsten such that the material parameter φ is less than or equal to 0.05, wherein φ is defined by:

$$\varphi = \frac{1}{D_{Ni}}\left[\frac{c'_W - c_W}{c_W D_W}\right]^{-1}$$

wherein $c_w$ is the concentration of tungsten in the matrix in at %, $c'_w$ is the concentration of tungsten in the γ'-phase in at %, $D_w$ is the coefficient of diffusion of tungsten and $D_{Ni}$ is the coefficient of diffusion of nickel taking into account the solubility differential of the elements between the matrix and the γ'-phase.

13. The method according to item 11, wherein in a further step the chemical composition is selected in terms of the element tungsten such that the material parameter φ is less than or equal to 0.05, wherein φ is defined by:

$$\varphi = \frac{1}{D_{Ni}}\left[\frac{c'_W - c_W}{c_W D_W}\right]^{-1}$$

wherein $c_w$ is the concentration of tungsten in the matrix in at %, $c'_w$ is the concentration of tungsten in the γ'-phase in at %, $D_w$ is the coefficient of diffusion of tungsten and $D_{Ni}$ is the coefficient of diffusion of nickel taking into account the solubility differential of the elements between the matrix and the γ'-phase.

14. The method according to any one of items 11 to 13, wherein in the third step, the percentage of aluminum is minimized and the percentage of germanium, titanium and/or tantalum is maximized, either individually or taken together.

15. The method according to any one of items 11 to 14, wherein the percentage of germanium, titanium and/or tantalum either individually or taken together is adjusted such that the percentage of tungsten and/or molybdenum in the matrix, either individually or taken together, is greater, in particular 1.5 times greater than the respective percentage of tungsten and/or molybdenum in the γ'-phase.

What is claimed is:

1. A nickel-based alloy having a microstructure with a matrix of γ-phase and precipitates of γ'-phase, wherein the γ'-phase comprises from 50 vol % to 80 vol % in a temperature range of from 1000° C. to 1100° C. and the nickel-based alloy comprises, based on a total alloy, from 10 to 13 at % aluminum,
from 3 to 14 at % cobalt,
from 4 to 12 at % chromium,
from 0.6 to 8 at % molybdenum,
from 0 to 6 at % rhenium,
from 0.5 to 4 at % tantalum,
from 0.5 to 4 at % titanium,
from 0.3 to 3.5 at % tungsten,
from 0 to 4 at % germanium,
from 0 to 0.6 at % hafnium,
from 0 to 4 at % ruthenium,
balance nickel and unavoidable impurities, and wherein a percentage X of molybdenum and tungsten in the γ-phase, $X = 0.84\ C_{Mo} + C_W$, is greater than 5.5 at % at temperatures in a range of from 1000° C. to 1100° C., $C_{Mo}$ and $C_W$ representing concentrations of molybdenum and tungsten expressed in at %.

2. The nickel-based alloy of claim 1, wherein a distribution ratio of a concentration of tungsten and or molybdenum in the matrix relative to a respective concentration of tungsten and or molybdenum in the γ'-phase is greater than 1.

3. The nickel-based alloy of claim 1, wherein a distribution ratio of a concentration of tungsten and or molybdenum in the matrix relative to a respective concentration of tungsten and or molybdenum in the γ'-phase is at least 1.5.

4. The nickel-based alloy of claim 1, wherein the alloy has a solidus temperature higher than 1300° C.

5. The nickel-based alloy of claim 1, wherein a γ-/γ'-mismatch is from −0.15% to −0.25% in a temperature range of from 1000° C. to 1100° C., the γ-/γ'-mismatch being a difference between lattice constants of theγ and γ' phases, standardized on an averaged value of the lattice constants.

6. The nickel-based alloy of claim 1, wherein the alloy comprises from 10 to 12 at % aluminum.

7. The nickel-based alloy of claim 1, wherein the alloy comprises from 7 to 12 at % chromium.

8. The nickel-based alloy of claim 1, wherein the alloy comprises from 0.6 to 2 at % molybdenum.

9. The nickel-based alloy of claim 1, wherein the alloy comprises from 2.5 to 3.5 at % tungsten.

10. The nickel-based alloy of claim 1, wherein the alloy comprises germanium.

11. The nickel-based alloy of claim 1, wherein the alloy does not comprise rhenium.

12. A nickel-based alloy, wherein the alloy consists of 10 at % aluminum, 14 at % cobalt, 7 at % chromium, 2 at % molybdenum, 2.5 at % tantalum, 3 at % titanium, balance Ni and unavoidable impurities.

13. The nickel-based alloy of claim 1, wherein the γ'-phase comprises from 60 vol % to 80 vol % in a temperature range of from 1000° C. to 1100° C.

14. The nickel-based alloy of claim 1, wherein the γ'-phase comprises from 70 vol % to 80 vol % in a temperature range of from 1000° C. to 1100° C.

15. The nickel-based alloy of claim 1, wherein the alloy comprises hafnium.

16. The nickel-based alloy of claim 1, wherein the alloy comprises ruthenium.

17. The nickel-based alloy of claim 1, wherein the alloy comprises rhenium.

18. The nickel-based alloy of claim 1, wherein the alloy does not comprise ruthenium.

19. The nickel-based alloy of claim 1, wherein the alloy is present in monocrystalline form.

20. The nickel-based alloy of claim 1, wherein the alloy is present in directionally solidified form.

* * * * *